US005494202A

United States Patent [19]

Wyatt

[11] Patent Number: 5,494,202

[45] Date of Patent: Feb. 27, 1996

[54] GOLF ACCESSORY HOLDER

[76] Inventor: Sammy Wyatt, 106 Alton Dr., S.E., Calhoun, Ga. 30701

[21] Appl. No.: 337,868

[22] Filed: Nov. 14, 1994

[51] Int. Cl.[6] ..... A45F 5/00

[52] U.S. Cl. ..... 224/253; 224/252; 224/918; 224/919; 224/196; 211/15

[58] Field of Search ..... 224/252, 253, 224/918, 919, 196; 211/15

[56] References Cited

U.S. PATENT DOCUMENTS

| | | | |
|---|---|---|---|
| 1,810,491 | 6/1931 | McClure | 224/919 |
| 1,911,256 | 5/1933 | Andrew | 224/252 |
| 2,950,748 | 8/1960 | Olinghouse | 224/919 |
| 3,281,013 | 10/1966 | Motard | 224/919 |
| 4,082,209 | 4/1978 | Sanders | 224/919 |
| 4,798,319 | 1/1989 | James, Jr. | 224/196 |
| 4,850,483 | 7/1989 | Stack | 224/919 |
| 4,927,052 | 5/1990 | Marthaler et al. | 224/918 |
| 5,004,137 | 4/1991 | Wu | 224/919 |
| 5,040,675 | 8/1991 | Cleveland et al. | 211/15 |
| 5,183,154 | 2/1993 | Slemp | 224/919 |
| 5,288,002 | 2/1994 | Oh | 224/919 |

*Primary Examiner*—Henry J. Recla
*Assistant Examiner*—Charles R. Eloshway
*Attorney, Agent, or Firm*—Hopkins & Thomas; D. Scott Sudderth

[57] ABSTRACT

A golf accessory holder for holding one or more golf balls, golf tees and other golf accessories. The golf accessory holder includes a housing (12) having an inner chamber (21) in which golf balls are received. A pusher plate (36) mounted to a compression spring (32) engages and urges the golf balls into tight frictional engagement with a first end (13) of the housing (12) to secure the golf balls within the golf accessory holder.

9 Claims, 2 Drawing Sheets

GOLF ACCESSORY HOLDER

FIELD OF THE INVENTION

The present invention relates to a golf accessory holder. In particular, the present invention relates to a golf accessory holder that is mountable on the belt of a wearer and holds at least one golf ball and other accessories such as golf tees, ball markers, etc. to provide easy and quick access to such accessories by the wearer.

BACKGROUND OF THE INVENTION

The game of golf has become increasingly popular as a recreational sport today. However, golf is a difficult and often somewhat frustrating game. As a part of the game, most players typically tend to lose golf balls, tees, and other accessories as by breaking tees or hitting balls into water hazards, heavily wooden areas and due to the golf balls becoming sliced or otherwise marked. Also, other accessories such as ball markers and divot repair tools are needed for players to mark the position of their golf ball on a green and to fix divots or indentions in golf greens where the golf balls have landed. Accordingly, it is necessary for players to keep a supply of golf balls, tees, and other accessories handy for use as needed.

Many players typically like to keep extra golf balls, tees, etc. on their persons so that they will have a golf ball, etc. within easy access when needed instead of having to dig through their golf bag every time a new ball or tee is needed. Typically, the simplest place for players to keep extra golf balls, tees, divot tools, etc. is in their pants' pockets.

The problem with carrying such accessories in one's pants' pockets is that loading one's pockets with golf balls, tees, etc. is not very comfortable as loading such accessories into pockets generally makes loose clothing tight and tight clothing even tighter and thus somewhat restrictive. The accessories also can shift as the user moves, which can disrupt the swinging motion of the player, disrupting the player's shot. Further, with the player constantly needing to reach into the pockets of his pants to pull out a new ball or tee, etc. the player's pants tend to be dirtied by dirty hands, etc. It also is not easy to load the pockets of tight clothing with extra golf balls, etc. nor is it easy to remove such accessories, especially with a golf glove on one hand. Further, while tees, ball markers and divot tools are not especially sharp, such accessories are pointed and can injure the fingers, hands, etc. of the player as the player reaches into a pocket and can poke or jab the legs of the player while in the player's pockets.

Golf ball holders or caddies have been developed for holding golf balls and other accessories, many of which are designed to be mounted on the belt of a wearer or to a side of the golf bag. The problem with such conventional holders is that many are designed only to hold one ball and are not designed to hold other accessories such as golf tees, divot tools, etc. Additionally, most golf ball holders simply are open topped chutes or cups that rely on gravity to hold the ball(s) therein. Such open-ended cups or chutes are susceptible to the balls falling out or being otherwise urged out of the holder if the holder is jostled or shifted, as tends to happen when the player swings the golf club.

Accordingly, a need exists for a golf accessories holder that is mountable to the belt or waistband of a wearer and which can hold golf balls, tees and other small golf accessories securely to keep such accessories easily accessible to the wearer and out of the pockets of the wearer's clothing.

SUMMARY OF THE INVENTION

Briefly described, the present invention comprises a golf accessory holder for holding golf balls, golf tees, ball markers, and other accessories, and which is mountable upon the belt of a wearer. The golf accessory holder comprises a generally rectangularly shaped housing typically formed from a durable, rigid plastic material such as polypropylene or a similar material. The housing includes first and second ends, front and rear longitudinally extending side surfaces, a bottom surface and an upwardly facing top surface, which define a longitudinally extending inner chamber that extends between the first and second ends of the housing.

A substantially circularly shaped aperture or opening is formed in the top surface of the housing, the aperture having a diameter that is substantially greater than the diameter of a conventional golf ball. The aperture enables a golf ball to be placed within and removed from the inner chamber of the housing. Typically, the housing, and thus the inner chamber, is of a length, height and width sufficient to accommodate 1–2 golf balls within the inner chamber, although the housing can be sized to accommodate additional, i.e. 3, golf balls as desired.

A means for securing a golf ball within the inner chamber and urging the golf ball toward a position adjacent the first end of the housing, aligned with the aperture formed in the top surface of the housing is mounted within the inner chamber and is movable therealong. The means for securing the golf ball within the inner chamber includes a compression spring having a first end attached to the second end of the housing and a second end mounted to a pusher plate. The pusher plate generally is a substantially square plate of the height and width slightly less than the height and width of the inner chamber so that pusher plate can slide along the length of the inner chamber without twisting or binding against the walls of the inner chamber. The pusher plate is urged toward the first end of the housing and away from the second end of the housing by the force of the compression spring as the compression spring is uncoiled. The pusher plate engages the golf ball and urges it against the first end of the housing into tight frictional engagement therewith. As a result, the golf ball is held within the inner chamber in a position aligned with the aperture until sufficient force is applied to the golf ball to overcome the pressing force of the compression spring to remove the golf ball from the housing.

A clip is formed along the rear side surface of the housing. The clip is substantially U-shaped, extending slightly upwardly above the top surface of the housing and having a leg that extends substantially parallel to the rear side surface of the housing. The clip leg is spaced from the rear side surface of the housing to provide a gap into which the belt or waistband of a wearer can be received and held to secure the golf accessory holder to the waist of the wearer.

Additionally, tee openings are formed in the ends of the housing for receiving and holding a supply of golf tees in each end of the housing. A series of marker openings are formed in the top surface of the housing adjacent the rear side edge thereof. The marker openings are positioned between the second end of the housing and the aperture and are adapted to receive and hold one or more ball markers. The golf accessory holder thus can be used to hold one to three golf balls, depending on the size of the golf accessory holder, and holds multiple tees, ball markers, etc. on the belt of the wearer for easy access and use when needed.

Various objects, features and advantages of the present invention will become apparent to one of ordinary skill in the art upon reading the following specification, when taken in conjunction with the accompanying drawings.

DESCRIPTION OF THE PREFERRED EMBODIMENT

Figure 1:
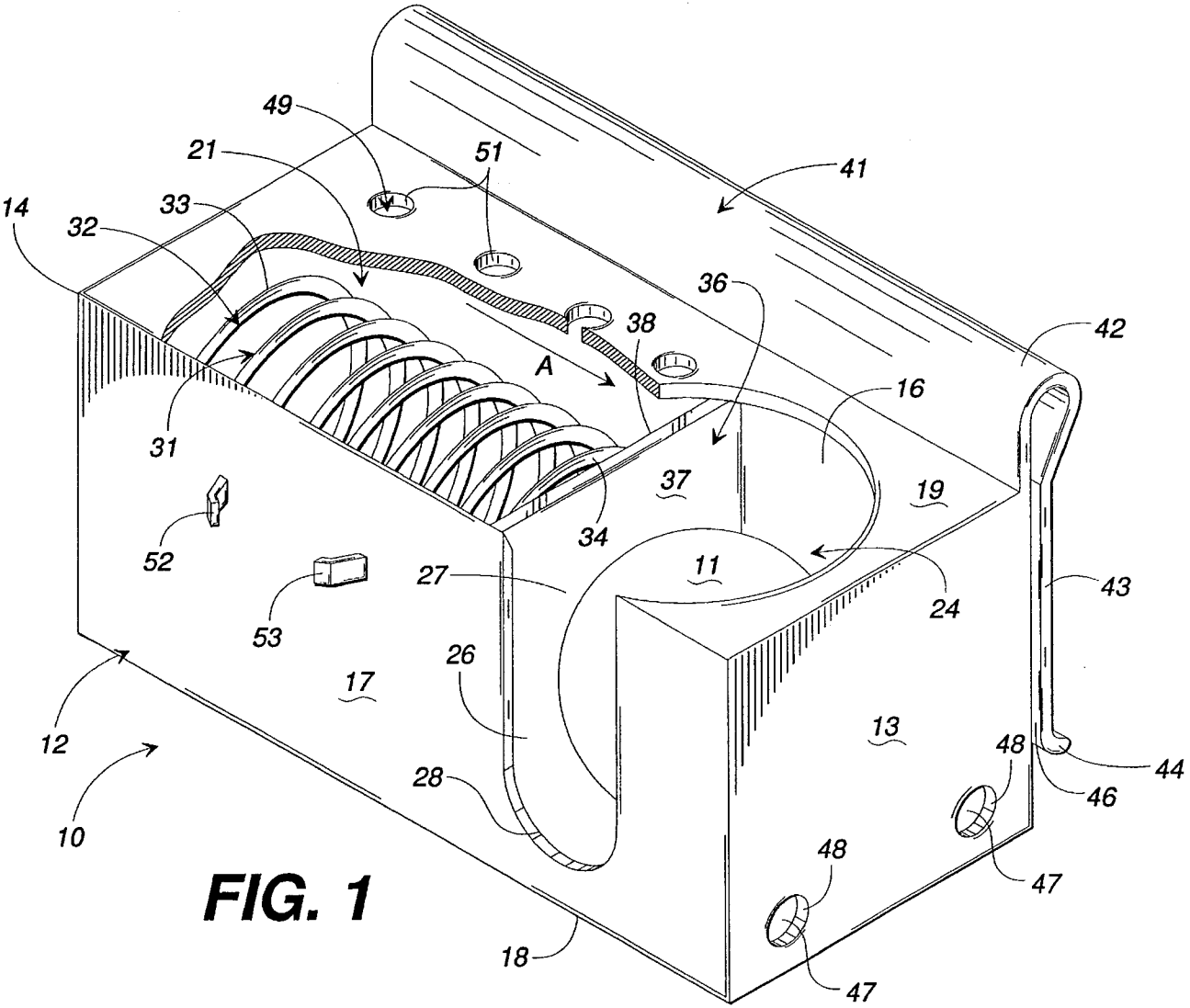
FIG. 1 is a perspective view of the golf accessory holder with portions broken away to illustrate the means for securing a golf ball within the housing.

Referring now in greater detail to the drawings in which like numerals indicate like parts throughout the several views, FIG. 1 illustrates a golf accessory holder 10 adapted to be mountable upon the belt or waistband of the pants (not shown) of a wearer and adapted to hold one or more golf balls 11 and other golf accessories such as tees, golf ball markers and divot tool if desired. The golf accessory holder 10 generally comprises a housing 12 that typically is a substantially rectangularly shaped box, although other shapes such as tubular, square, etc. also can be used for the housing. The housing 12 generally is formed from a light-weight, durable, substantially rigid material such as polypropylene or a similar plastic material, or can be made from a light-weight metal such as aluminum, and can be manufactured in a variety of different colors.

Figure 2:
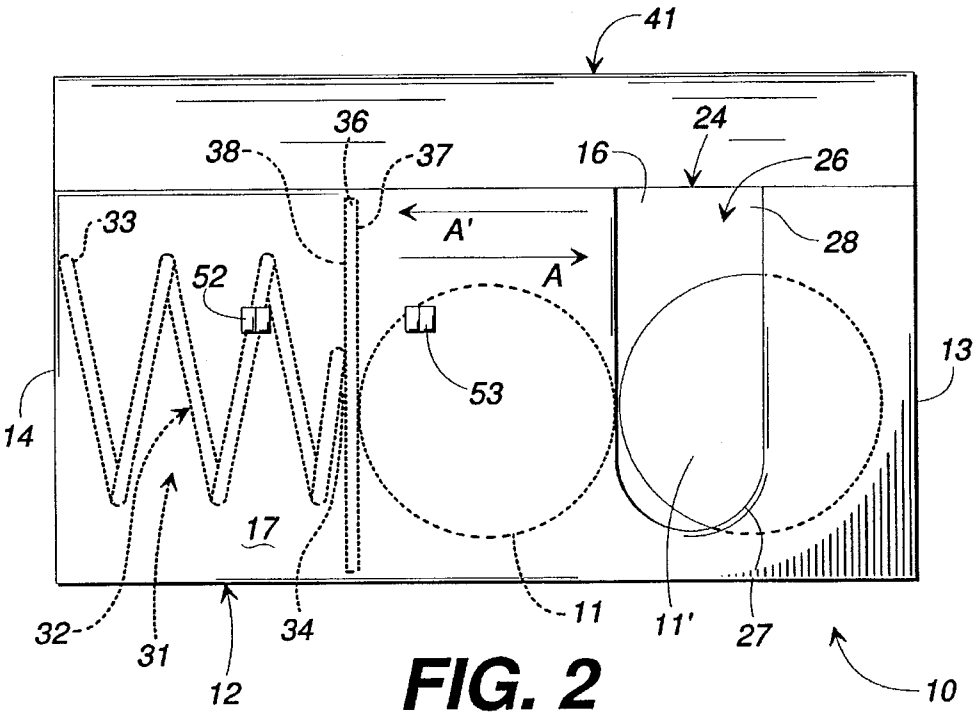
FIG. 2 is a front side elevational view of the golf accessory holder illustrating a pair of golf balls contained within the housing.

The housing includes a first end 13, a second end 14, a rearwardly facing longitudinally extending side surface 16, a longitudinally extending front side surface 17, a bottom surface 18 and an upwardly facing top surface 19. As FIG. 1 illustrates, an inner chamber 21 is formed within the housing, defined by the front and rear longitudinal side surfaces and the top and bottom surfaces of the housing. The inner chamber 21 extends along the length of the housing between the first end 13 and second end 14 and generally is of a height and width, or diameter, that is substantially greater than the diameter of the golf ball 11. The length of the inner chamber is dependent upon the length of the housing and thus will be of a length capable of accommodating multiple golf balls, as shown in FIG. 2, depending on the size of the housing desired. Typically, the housing will be sized to hold between 1–3 golf balls.

As illustrated in FIG. 1, an aperture 24 is formed in the top surface 19 of the housing 12. The aperture 24 is a substantially circular opening formed through the top surface of the housing into the inner chamber 21 and is of a diameter substantially greater than the diameter of golf ball 11. The aperture thus enables golf balls to be deposited into and removed from the inner chamber 21. A notch 26 is formed in front side surface 17 of housing 12, aligned with the aperture. The notch 26 is a substantially U-shaped opening formed in front side surface 17, and has an open end 27 formed along a side of the aperture 24 and a closed end 28 adjacent the bottom surface 18 of the housing. The width of the notch is substantially less than the diameter of the golf ball 11, but is sufficient to enable a wearer to insert a finger through the front side surface of the housing into engagement with the golf ball for urging the golf ball 11 upwardly and through the aperture 24 to remove the golf ball from the housing.

As shown in FIGS. 1 and 2, a means 31 for securing the golf balls 11 within the inner chamber 21 is positioned in the inner chamber and engages and urges the golf ball 11 in the direction of arrow A. The means for securing 31 includes a compression spring 32 having a first end 33 attached to the second end 14 of the housing 12, and a second end 34 that projects away from the first end 33, extending along the length of the inner chamber as the spring is decompressed. A pusher plate 36 is mounted to the second end 34 of the spring 32 and is moved along the length of the inner chamber in the direction of arrows A and A' (FIG. 2) with the decompression and compression of the spring. The pusher plate generally is a substantially square or rectangularly shaped plate that is of a height and width that is slightly less than the height and width of the inner chamber. As a result, the pusher plate fits within the side walls 22 of the inner chamber 21 and slides therealong without engaging or binding against the side walls of the inner chamber. The pusher plate includes a front surface 37 that engages the golf ball 11 and a rear surface 38 mounted to the second end 34 of spring 32.

Figure 3:
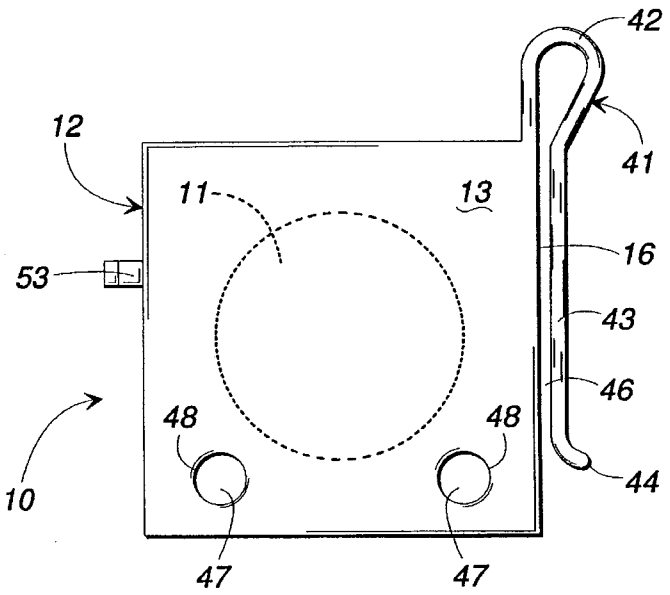
FIG. 3 is an end view of the golf accessory holder illustrating the clip for attaching the golf accessory holder to the belt of a wearer.

As shown in FIGS. 1 and 3, a clip 41 is formed at the adjacent longitudinal rear side surface 16 of the housing 12. The clip generally is formed as a part of the housing if the housing is formed from an extruded plastic material, or can be formed as a separate clip that is rivetted or otherwise fastened to the rear side surface of the housing. The clip 41 is a substantially U-shaped member having an upper end 42 spaced above the top surface of the housing and a leg 43 that extends downwardly from the upper end substantially parallel to and spaced from rear side surface 16. As shown in FIG. 3, the leg has a flared lower end 44 that curves laterally away from the rear side surface of the housing. The spacing between the leg 43 of the clip 41 and rear side surface 16 of the housing is sufficient to receive therein the belt or waistband (not shown) of a wearer for mounting the golf accessory holder 10 (FIG. 1) about the waist of the wearer. The clip 41 is somewhat resilient and thus tends to engage the waistband or belt of the wearer in tight frictional engagement between the leg of the clip and the rear side surface of the housing to prevent the golf accessory holder from sliding or easily slipping off the belt or waist band of the wearer's pants. Additionally, the flared lower end 44 of the clip helps guide the waist band or belt of the wearer's pants into the slot 46 for ease of mounting the golf accessory holder to the belt or waistband of the wearer's pants.

As shown in FIGS. 1 and 3, a series of tee openings 47 are formed in the ends 13 and 14 of the housing 12. The tee openings 47 generally are substantially circular openings adapted to receive the stem of a golf tee (not shown) therein. The tee openings each have a circular side edge 48 that frictionally engages the stem of a golf tee as the tee is urged into each tee opening so as to secure a series of golf tees within the tee openings. Typically, there are at least two to four tee openings 47 formed in the housing, although additional tee openings can be formed therein if so desired.

Additionally, as FIG. 1 illustrates, a series of marker openings 49 are formed in the top surface 19 of the housing 12 adjacent the clip 41. The marker openings are small diameter holes or apertures formed in the top surface, of a diameter approximately equivalent to that of the stem or pin of a ball marker (not shown). Thus, as the stems of ball markers are urged into the marker openings 49, the stems are frictionally engaged by the sidewalls 51 of the marker openings 49 to hold the ball markers on the top surface of the housing.

As further illustrated in FIGS. 1 and 2, a pair of hooks or clasps 52 and 53 are positioned along the front side surface 17 of the housing 12. The hooks are substantially L-shaped members that can be formed with the housing if the housing is formed from a plastic material, or can be attached to the front side surface of the housing. The hooks are spaced from each other and are adapted to receive a divot tool (not shown), for fixing divots or marks in greens, etc., therebetween. The divot tool is slid or snapped between the hooks 52 and 53 and is held in place by the inherent resiliency of the hooks so that the divot tool can be kept handy for use when needed.

To use the golf accessory holder 10, as shown in FIG. 2, the wearer simply inserts a golf ball 11 into the inner chamber 21 through the aperture 24 formed in the top surface 19 of the housing 12. As the golf ball 11 contacts pusher plate 36, the golf ball tends to urge the pusher plate in the direction of arrow A'. As shown in FIG. 2, as the pusher plate is moved in the direction of arrow A', spring 32 is compressed toward the second end 14 of the housing 12. The resistance of the spring to compression by the movement of the pusher plate causes the golf ball 11 to be held between the pusher plate and the first end 13 of the housing 12 in tight frictional engagement therewith. As a result, as the golf accessory holder is inverted or jostled, etc., the golf ball is retained securely within the inner chamber 21.

A second golf ball 11' (FIG. 2) can be inserted into the inner chamber 21 by urging the second golf ball through the aperture 24 in the top surface of the housing. As the second golf ball is urged through the aperture the first golf ball 11 is urged against the pusher plate and spring and toward the second end of the housing. This creates a gap for the second golf ball, which is received between the first golf ball and the first end 14 of the housing. The force of the spring urging the pusher plate in the direction of the arrow A tends to urge the first golf ball into tight contact with the second golf ball. The second golf ball, thus is held in tight frictional engagement between the first golf ball and the first end of the housing to secure the second golf ball within the inner chamber of the golf accessory holder. If the golf accessory holder is sized to fit three golf balls, the procedure is repeated to deposit a third golf ball within the inner chamber.

In addition to retaining golf balls, the golf accessory holder can be used to hold other golf accessories such as golf tees, ball markers, etc. Typically, golf tees are inserted through the tee openings 47 formed in the first and second ends 13 and 14 of the housing of the golf accessory holder with the sides of the tee stems being engaged and held in frictional engagement with the sidewalls 48 of the tee openings 47. Likewise, ball markers can be inserted into marker openings 49 formed in the top surface 19 of the housing by inserting the stems of the ball markers into the marker openings with the stems being engaged and held in frictional engagement by the sidewalls 51 of the marker openings. Further, a divot tool (not shown) can be mounted to the front side surface 17 of the golf accessory holder by sliding or snap fitting the divot tool in between hooks 52 and 53.

With the golf accessory holder loaded with golf balls 11, golf tees, ball markers and other accessories as desired, the golf accessory holder is mounted on the belt or waist band of the pants of the wearer by hooking the leg 43 of the clip 41 over the belt or waistband of the wearer's pants. The golf accessory holder then is urged downwardly so that the belt or waistband slides into the slot 46 formed between the leg 43 and rear side surface 16 of the housing of the golf accessory holder. The golf accessory holder can be positioned anywhere about the waist of the wearer as is most comfortable and convenient for the wearer.

If the wearer needs an additional golf ball, the wearer simply inserts a finger into the notch 26 formed in the front side surface 17 of the golf accessory holder and urges the golf ball 11 (FIG. 1) upwardly through the aperture 24 to remove the golf ball from the inner chamber 21 of the golf accessory holder. Once the golf ball has been removed, any additional golf balls contained within the inner chamber are urged along the length of the inner chamber toward the first end of the housing in the direction of arrow A. Such movement positions the next golf ball in the inner chamber in alignment beneath the aperture for easy access when needed. The golf tees, ball markers and divot tool likewise can be removed from their tee openings, etc. when needed, and after use, can be replaced quickly and easily to keep such accessories handy for the next use.

Accordingly, it can be seen that the present invention provides a golf accessory holder that is mountable to the belt or waistband of the pants of the wearer so as to keep extra golf balls, tees and other accessories handy and easily accessible for use by the wearer when needed. Further, it will be understood by those skilled in the art that numerous modifications and changes may be made thereto without departing from the spirit and scope of the invention as set forth in the following claims.

I claim:

1. A golf accessory holder mountable on a belt worn by a wearer for holding at least one golf ball, comprising:

an elongated holder housing having a longitudinally extending inner chamber adapted to receive a golf ball therein, said housing having opposite longitudinal ends and top, bottom, and side walls connected therebetween;

an aperture formed in said top wall of said housing adjacent a first longitudinal end thereof for enabling a golf ball to pass therethrough into and out of said inner chamber;

a notch formed in a first side wall of said holder housing adjacent said aperture, and extending upwardly along said side wall and communicating with said aperture thereby defining a single opening in said housing to enable access to said inner chamber for easy removal of the golf ball therefrom;

means for securing the golf ball within said inner chamber and for urging the golf ball toward said first longitudinal end of said housing toward alignment with said aperture, said means for securing the golf ball mounted to a second longitudinal end of said housing which urges the golf ball against said first longitudinal end to secure against inadvertent release of the golf ball through said aperture; and, means for mounting the golf accessory holder housing on the belt of a wearer, attached to the golf accessory holder housing along a second side wall thereof.

2. The golf accessory holder of claim 1 and wherein said means for securing the golf ball comprises a compression spring having a first end mounted to said second longitudinal end of said holder housing and a second end mounted to a pusher plate that engages and urges the golf ball along said inner chamber.

3. The golf accessory holder of claim 1 and further including a series of apertures formed in at least one longitudinal end of said holder housing and adapted to receive and hold a plurality of golf ball tees.

4. The golf accessory holder of claim 1 and further including a plurality of ball marker openings formed in said top wall of said holder housing and adapted to receive and hold a series of ball markers.

5. The golf accessory holder of claim 1 and wherein said means for mounting comprises a clip attached to said second side wall of said holder housing and spaced therefrom so that the belt of the wearer is received and engaged between said clip and said second side wall of said ball holder housing to mount the golf ball holder on the belt of the wearer.

6. A golf accessory holder for holding golf balls, golf tees and other accessories on an article of clothing worn by a wearer, comprising:

a housing having first and second ends, a front side, rear side, and an upwardly facing top surface, defining an inner chamber adapted to receive a golf ball therein, an aperture formed through said top surface, a notch formed in said front side, said notch extending upwardly along said front side and communicating with said aperture thereby defining a single opening in said housing to enable the golf ball to be passed therethrough into and out of said inner chamber;

means for securing the golf ball in said inner chamber and for urging the golf ball toward a position aligned with said aperture, said means for securing mounted to said second end of said housing and movable toward said first end of said housing;

means for releasably mounting additional golf accessories, including golf tees, to said housing; and means for releasably mounting the golf accessory holder to an article of clothing of a wearer, mounted no said rear side of said housing.

7. The golf accessory holder of claim 6 and wherein said means for mounting comprises a clip attached to said housing and extending parallel to said rear side of said housing and spaced therefrom so that the belt of the wearer is received and engaged between said clip and said rear side of said housing to mount the golf accessory holder on the wearer's belt.

8. The golf accessory holder of claim 6 and wherein said means for securing the golf ball comprises a compression spring having a first end mounted to said second end of said housing and a second end mounted to a pusher plate that engages and urges the golf ball along said inner chamber.

9. The golf accessory holder of claim 6 and wherein said means for mounting additional golf accessories to said housing comprises a series of tee openings formed in at least one end of said housing and adapted to receive and hold a series of golf tees.

* * * * *